US006758661B1

(12) United States Patent
Thelen

(10) Patent No.: US 6,758,661 B1
(45) Date of Patent: Jul. 6, 2004

(54) INLET FORWARD SUPERCHARGER

(75) Inventor: Daniel L. Thelen, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/358,663

(22) Filed: Feb. 5, 2003

(51) Int. Cl.[7] ..... F04C 18/00
(52) U.S. Cl. ..... 418/206.4; 418/206.1
(58) Field of Search ..... 418/206.4, 206.1; 123/559.1

(56) References Cited

U.S. PATENT DOCUMENTS 2,287,716 A 6/1942 Whitfield
4,768,934 A * 9/1988 Soeters, Jr. ..... 418/1
5,078,583 A * 1/1992 Hampton et al. ..... 418/206.5
5,281,116 A * 1/1994 Gwin ..... 418/94
5,527,168 A * 6/1996 Juday ..... 418/201.1
5,702,240 A * 12/1997 O'Neal et al. ..... 418/206.4
5,893,355 A 4/1999 Glover et al.
6,253,747 B1 * 7/2001 Sell et al. ..... 418/206.5

* cited by examiner

*Primary Examiner*—Thomas Denion
*Assistant Examiner*—Theresa Trieu
(74) *Attorney, Agent, or Firm*—L. J. Kasper

(57) ABSTRACT

A rotary blower (26) of the Roots type, used as an engine supercharger, comprising a housing (50,52) including a forward wall portion (52F) defining an inlet port (30) disposed toward the upper portion of the housing. Typically, the housing defines an outlet port (34) on the underside (54) of the blower. Disposed within the housing is a pair of meshed, lobed rotors (28,29), with one of the rotors being driven by an input shaft (62). The blower includes a pair of timing gears (58,60) disposed adjacent the rearward end (52R) of the housing. The housing includes an inlet duct (32) disposed above the input shaft (62) and extending forwardly and transversely (FIG. 2) from the housing, and having a duct opening (70) in open communication with the inlet port (30). The arrangement of the invention provides substantially improved air flow efficiency through the blower, which corresponds to improved horsepower output of the engine on which the rotary blower is being used.

6 Claims, 5 Drawing Sheets

INLET FORWARD SUPERCHARGER

BACKGROUND OF THE DISCLOSURE

The present invention relates to rotary blowers of the Roots-type, and more particularly, to such blowers of the backflow-type.

As is well known, Roots-type blowers include lobed rotors meshingly disposed in transversely overlapping cylindrical chambers defined by a housing. Spaces between adjacent unmeshed lobes of the rotors transfer volumes of air from an inlet port opening to an outlet port opening, without mechanical compression of the air within the spaces. Stated another way, a Roots-type blower achieves pressure boost, not by internally compressing the air being transferred, but instead, achieves pressure boost simply by transferring a volume of air which is greater than the volume displacement of the device with which the blower is associated.

Typically, Roots-type blowers such as those described above are used as superchargers for vehicle engines, wherein the engine provides the mechanical input drive torque to the blower rotors. The volume of air transferred to the outlet port of the blower is then utilized to provide a pressure "boost" within the intake manifold of the vehicle engine, in a manner which is now well know to those skilled in the art, but which is only indirectly relevant to the present invention.

A typical Roots blower supercharger of the type sold commercially by the assignee of the present invention is illustrated and described in U.S. Pat. Nos. 5,527,168 and 5,893,355, both of which are assigned to the assignee of the present invention and incorporated herein by reference. In the typical Roots blower supercharger installation, the blower rotors rotate about axes which are oriented longitudinally ("north-south") within the vehicle engine compartment. The mechanical input drive torque from the engine is transmitted to the blower by means of an input pulley and an input shaft disposed on the forward end of the blower. The input torque is transmitted to the pulley, and then by means of the input shaft to a pair of timing gears which are typically mounted on the forward ends of the rotor shafts and are included to insure that the rotors mesh, but do not make physical contact with each other, a requirement which is well know to those skilled in the art.

In the typical prior art Roots blower supercharger, in its conventional installation, the inlet port and the "leading end" of the rotors are disposed at the rearward end of the blower housing (so inlet air flows axially into the rotor chamber), and the "trailing end" of the rotors and the larger (wider) portion of the outlet port are disposed toward the forward end of the blower housing, and typically, on the underside. Although the above-described conventional arrangement has been in widespread commercial use, and may be acceptable in some vehicle applications, it is not fully desirable in most vehicle applications, because of the need to provide ducting to communicate induction air from the forward portion of the engine compartment around a bend (with the ducting now extending forwardly), to the inlet port at the rearward end of the supercharger. In most of those applications, there is very little room, axially, between the rearward end of the supercharger and the cowl and dash sheet metal. If it is even possible to fit the inlet ducting into the space available, the resulting sharp bend (or turn) in the ducting reduces the air flow of the blower, and therefore, the overall performance of the blower.

The above-described arrangement also adds substantially to the total amount of ducting required, thus making it much more difficult and expensive to package the supercharger within the engine compartment. In an effort to improve the packaging of the blower and reduce the amount of ducting required, those skilled in the art have developed what is referred to as a "top inlet" blower, in which the duct carrying inlet air passes over the top of the blower, then turns downwardly to an inlet port on the upper side of the blower, typically, near the rearward end of the blower. Although such top inlet blowers require less ducting, there is still a sharp bend of the ducting down to the inlet port, and a requirement that the air flow make a sharp turn, thus providing less air flow through the blower than in the case of the rear inlet type. As is well known to those skilled in the blower art, having inlet air flow axially into the rotor chambers is inherently more efficient than having inlet air enter the rotor chamber from the top. In addition, the presence of the inlet ducting above the blower causes the overall assembly height to be excessive for most vehicle applications.

BRIEF SUMMARY OF THE INVENTION

Accordingly, it is an object of the present invention to provide an improved rotary blower assembly, especially of the Roots blower type, useable as a vehicle supercharger, which overcomes the disadvantages of the prior art blower installations described above.

It is a more specific object of the present invention to provide such an improved blower assembly which makes it possible to substantially reduce the amount of inlet ducting required, as well as the occurrence of sharp bends in the ducting.

It is another object of the present invention to provide such an improved blower assembly and installation which accomplishes the above-stated objects, while at the same time making it possible to reduce the overall mounting height of the blower installation, including the inlet ducting.

The above and other objects of the invention are accomplished by the provision of an improved rotary blower of the backflow type comprising a housing, first and second meshed lobed rotors, each lobe having a leading end and a trailing end. The rotors are rotatably disposed in the housing for transferring relatively low pressure inlet port air to relatively high pressure outlet port air. First and second meshed timing gears are fixed to be non-rotatable relative to the first and second rotors, respectively, for preventing contact of the meshed lobes of the rotors. An input drive member is adapted to transmit an input drive torque to the first rotor, the housing defining an inlet port and an outlet port.

The improved rotary blower is characterized by the housing having a rearward end and a forward end, adapted to be oriented toward the forward end of a vehicle engine compartment, the input drive member extending forwardly from the forward end of the housing. The inlet port is disposed at the forward end of the housing adjacent the leading end of the rotors and being defined substantially by a forward end wall of the housing and being disposed above the input drive member. The housing includes a duct portion in open fluid communication with the inlet port, the duct portion extending forwardly and defining a forward duct opening.

In accordance with another aspect of the invention, the improved rotary blower is characterized by the duct portion extending both forwardly and transversely, whereby the forward duct opening is disposed transversely from the input drive member.

DETAILED DESCRIPTION OF THE PREFERRED EMBODIMENT

Figure 1:
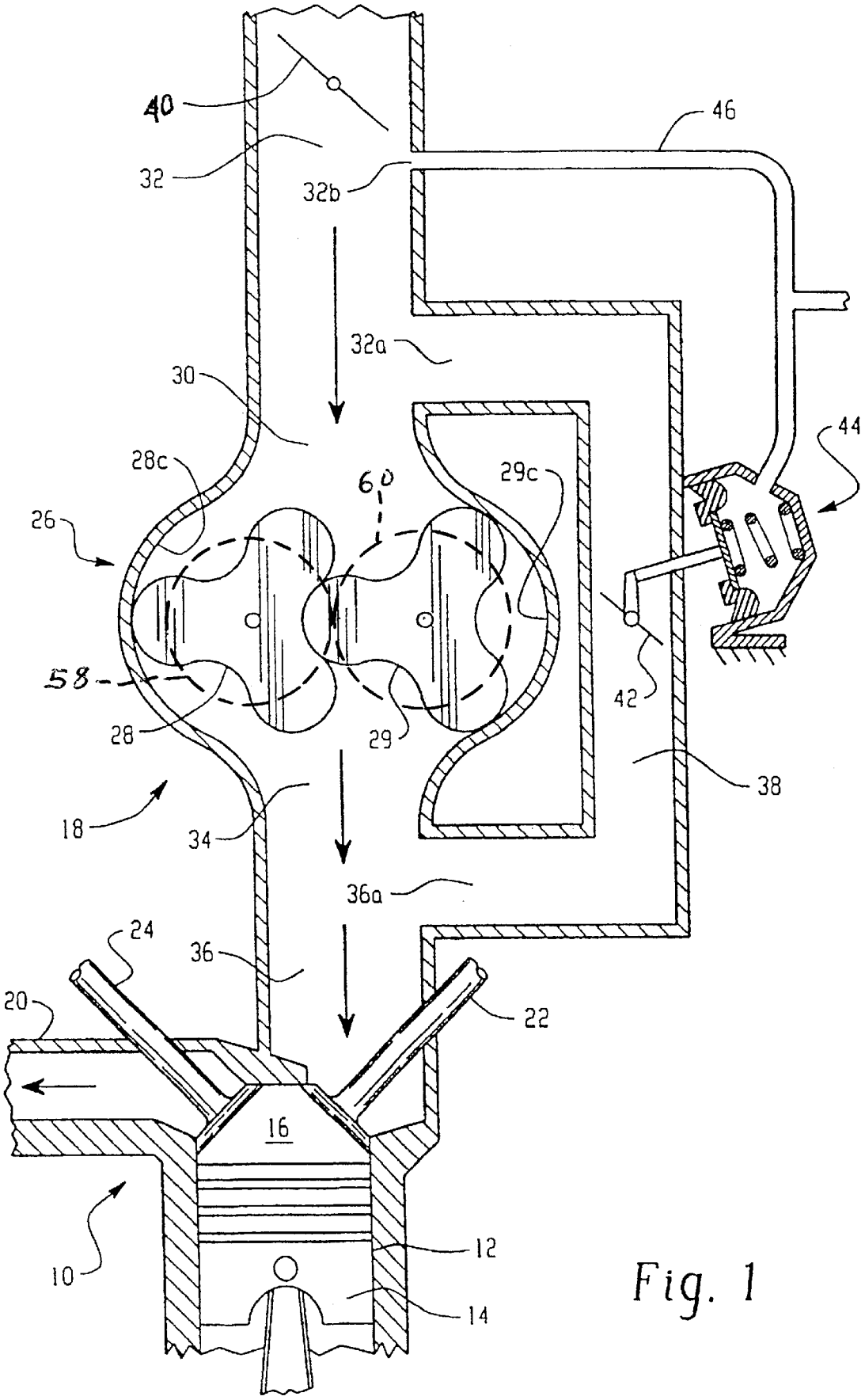
FIG. 1 is a schematic illustration of an intake manifold assembly having a positive displacement rotary blower or supercharger therein for boosting intake pressure to an internal combustion engine.

Referring now to the drawings, which are not intended to limit the invention, FIG. 1 is a schematic illustration of an intake manifold assembly, including a Roots blower supercharger and bypass valve arrangement of the type which is now well known to those skilled in the art, and is in widespread commercial usage. An engine, generally designated 10, includes a plurality of cylinders 12, and a reciprocating piston 14 disposed within each cylinder, thereby defining an expandable combustion chamber 16. The engine includes intake and exhaust manifold assemblies 18 and 20, respectively, for directing combustion air to and from the combustion chamber 16, by way of intake and exhaust valves 22 and 24, respectively.

The intake manifold assembly 18 is as illustrated and described in the above-incorporated patents. The blower (supercharger) 26 includes a pair of rotors 28 and 29 (shown only in FIG. 1 for simplicity), each of which includes a plurality of meshed lobes. The rotors 28 and 29 are disposed in a pair of parallel, transversely overlapping cylindrical chambers 28*c* and 29*c*, respectively, chamber 29*c* also being visible in FIG. 5. The rotors may be driven mechanically by engine crankshaft torque transmitted thereto in a known manner, such as by means of a drive belt (not illustrated herein), as will be described further hereinafter. The mechanical drive rotates the blower rotors 28 and 29 at a fixed ratio, relative to crankshaft speed, such that the blower displacement is greater than the engine displacement (i.e., the sum of the displacements of all of the combustion chambers 16), thereby "boosting" the pressure of the air flowing to the combustion chambers 16.

Referring now also to FIGS. 2–5, the supercharger (blower) 26 includes an inlet port 30 (see also FIG. 5) which receives air or air-fuel mixture from an inlet duct or passage 32, and further includes a discharge or outlet port 34 (also shown in FIG. 5), directing the charged air to the intake valves 22 by means of a duct 36, shown only in FIG. 1. As is fully shown only in FIG. 1, the inlet duct 32 and the discharge duct 36 are interconnected by means of a bypass passage, shown schematically at 38 (see also FIG. 5). If the engine 10 is of the Otto cycle type, a throttle valve 40 (shown only in FIG. 1) preferably controls air or air-fuel mixture flowing into the intake duct 32 from a source, such as ambient or atmospheric air, in a well known manner. Alternatively, the throttle valve 40 may be disposed downstream of the supercharger 26.

If the lobes of the rotors 28 and 29 are of the "twisted" type, i.e., having a helix angle (typically, about sixty degrees over the length of the lobes), the portion of each lobe adjacent the inlet port 30 comprises a "leading end" of the lobe, and the portion of each lobe adjacent the rearward end of the outlet port 34 comprises a "trailing end" of the lobe. By way of explanation only, the view of the rotors in the schematic of FIG. 1, which corresponds to a view looking in a rearward direction, shows the leading end of each lobe.

Disposed within the bypass passage 38 is a bypass valve 42, which is moved between an open position (shown somewhat open in FIG. 1) and a closed position (see FIG. 5) by means of an actuator assembly, generally designated 44. The actuator assembly 44 is responsive to fluid (air) pressure in the inlet duct 32 by means of a vacuum line 46. Therefore, the actuator assembly 44 is operative to control the supercharging pressure in the discharge duct 36 as a function of engine power demand. When the bypass valve 42 is in the fully open position, air pressure in the duct 36 is relatively low, but when the bypass valve 42 is fully closed, the air pressure in the duct 36 is relatively high. Typically, the actuator assembly 44 controls the position of the bypass valve 42 by means of suitable linkage. Those skilled in the art will understand that the illustration herein of the bypass valve 42 is by way of generic explanation and example only, and that, within the scope of the invention, various other bypass configurations and arrangements could be used, such as a modular (integral) bypass or an electronically operated bypass, or in some vehicle applications, there may be no bypass valve at all.

Referring now primarily to FIGS. 2–5, the blower 26 is seen in top plan view and includes a housing assembly generally designated 50. The housing assembly 50 includes a main blower housing 52 which defines the cylindrical chambers 28*c* and 29*c* shown schematically in FIG. 1. The main blower housing 52 includes a lower flange portion 54 (the numeral "54" also being used to refer to the "underside" of the blower), by means of which the entire blower 26 may be bolted to the intake manifold assembly 18. As may best be seen in FIG. 5, the main blower housing 52 and lower flange portion 54 cooperate to define the outlet port 34, which is disposed generally toward the rearward end (left end in FIGS. 2, 4 and 5) of the housing 52. The housing 52 includes a forward wall portion 52F (which actually defines the inlet port 30), and a rearward wall portion 52R. In the subject embodiment, and by way of example only, the forward wall portion 52F is cast integrally with the housing 52, while the rearward wall portion 52R comprises a separate, bolted on member, although within the scope of the invention the reverse arrangement could be utilized.

Figure 4:
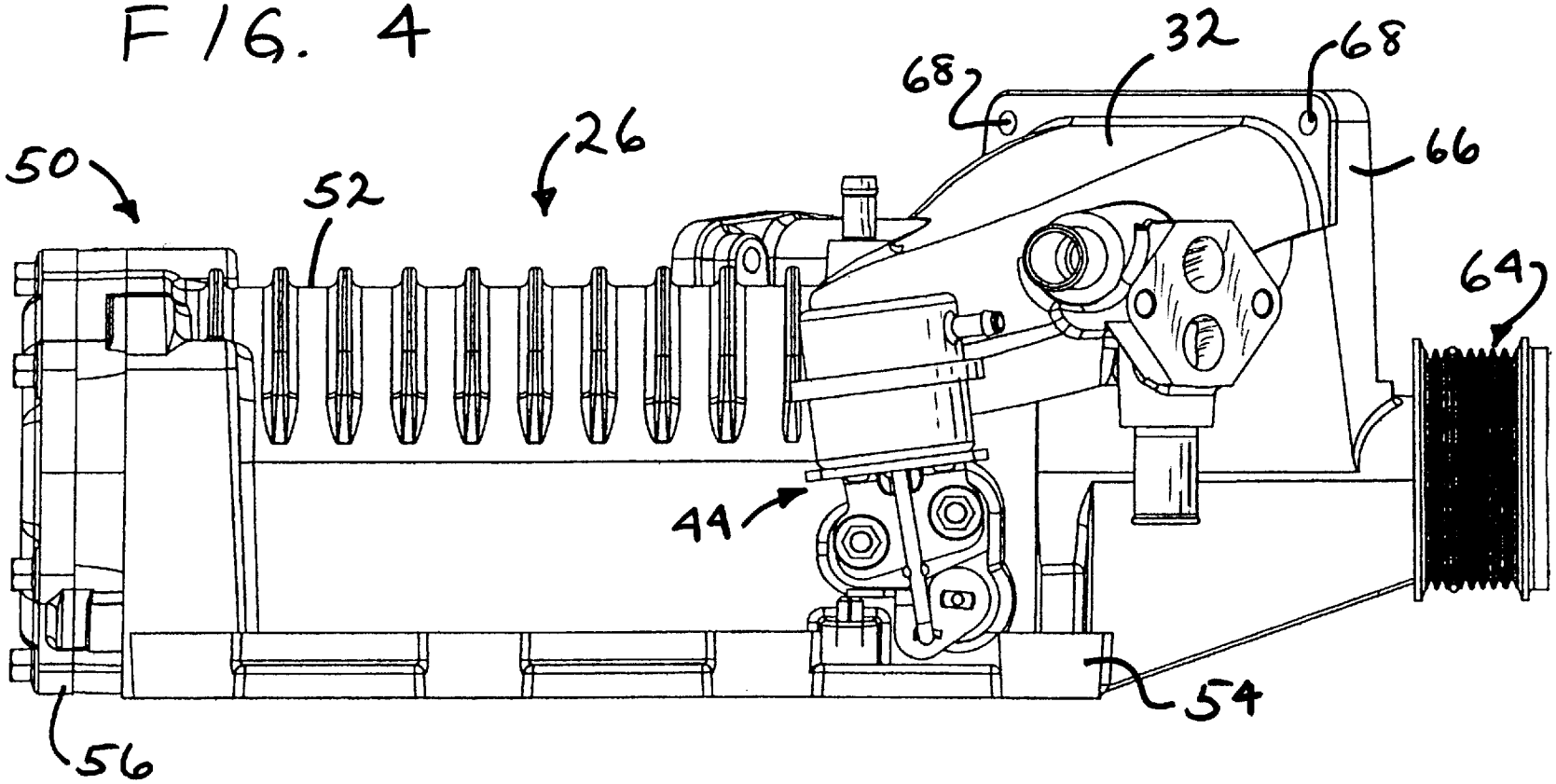
FIG. 4 is a side elevation of the blower of the present invention, viewed from the left in FIG. 3, but on approximately the same scale as FIG. 2.
Figure 5:
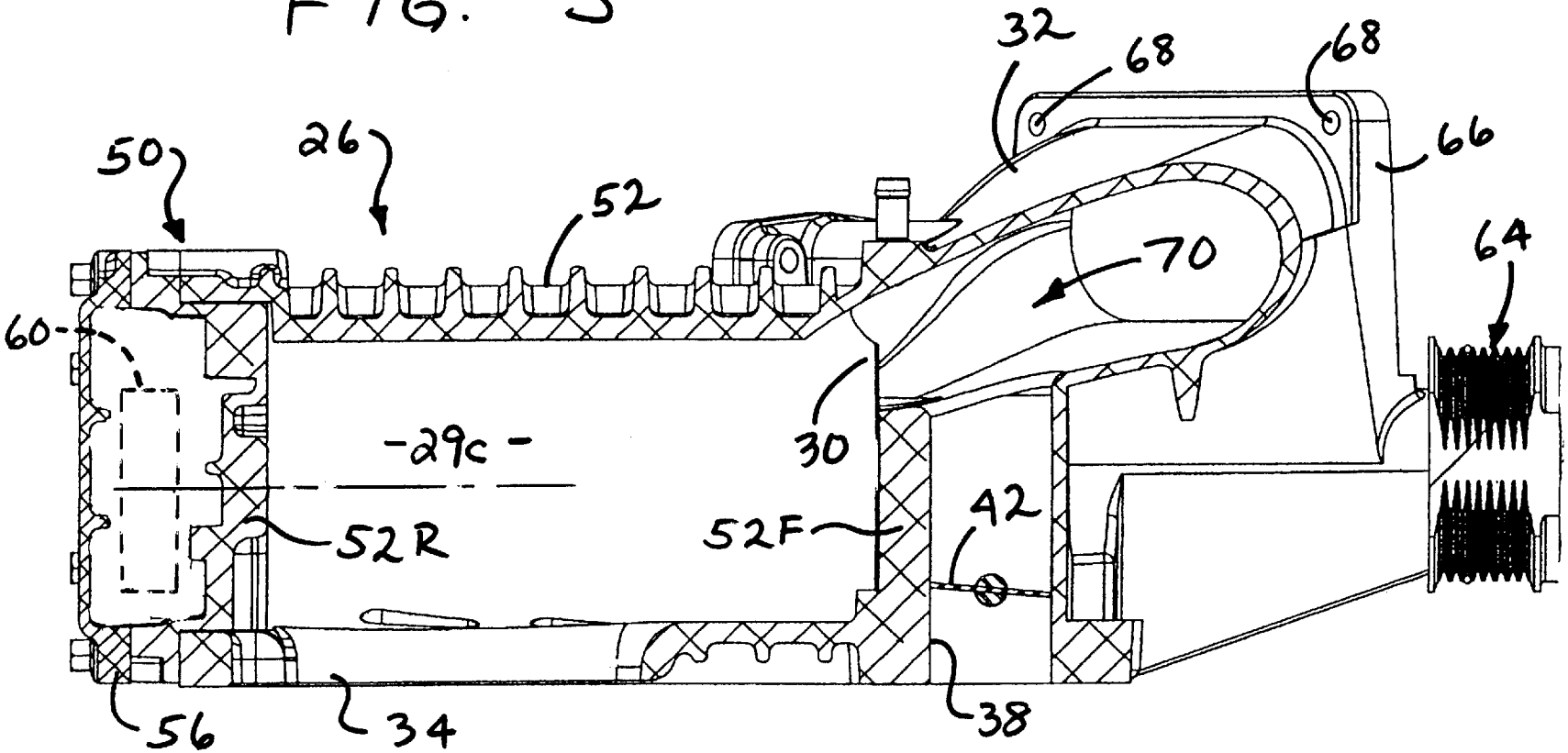
FIG. 5 is an axial cross-section, taken on line 5—5 of FIG. 2, and on substantially the same scale as FIG. 2, illustrating one important aspect of the present invention.

Attached to the rearward end (left end in FIGS. 2, 4 and 5) of the main blower housing 52 is a timing gear cover 56, within which are disposed the timing gears 58 and 60 (shown schematically in FIG. 1), the timing gear 60 being shown in dashed, outline form in FIG. 5. The timing gears 58 and 60 are fixed to rotate with the rotors 28 and 29, respectively, as is shown schematically in FIG. 1, and as is well known to those skilled in the art, are normally disposed at the forward end of the blower, especially on a rear inlet blower. Those skilled in the art of superchargers will understand, however, that the construction details of the timing gears 58 and 60 form no part of the present invention. Instead, all that is important, in regard to the timing gears, for purposes of the present invention, is that the timing gears 58 and 60 are preferably disposed at the rearward end of the blower 26, out of the way of other structure to be described subsequently. The rearward location of the timing gears 58 and 60, as illustrated in FIG. 5, allows the possibility of reduced overall blower height, without interfering with the inlet port 30.

Figure 2:
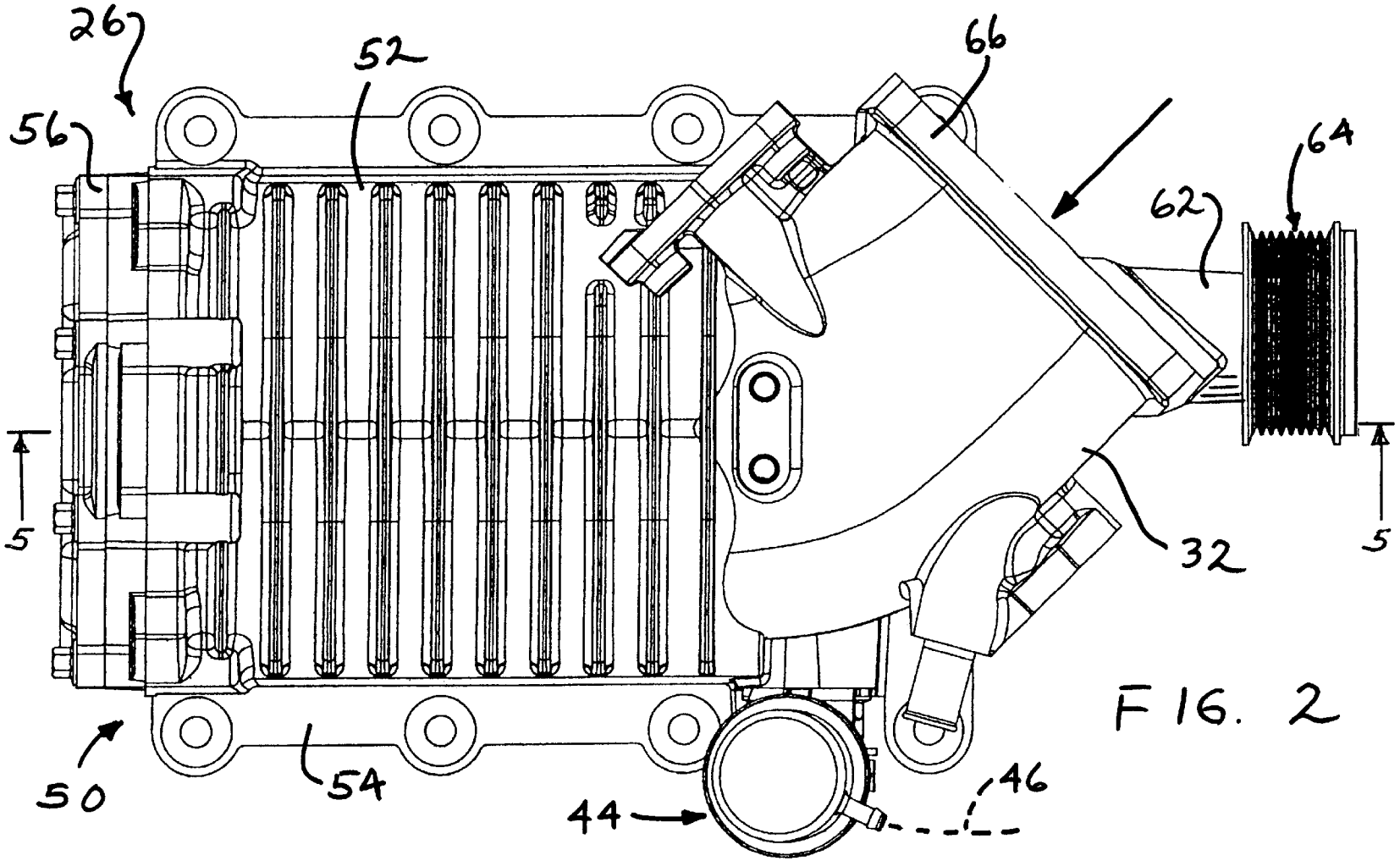
FIG. 2 is a top plan view of the blower shown schematically in FIG. 1, wherein the blower is made in accordance with the present invention.

Extending forwardly out of a forward end (right end in FIGS. 2, 4 and 5) of the main blower housing 52 is an input shaft 62 (which is partially hidden in FIG. 2, and almost totally hidden in FIGS. 4 and 5). Fixed to a forward end of the input shaft 62 is a pulley member 64, by means of which input torque is transmitted from the vehicle prime mover (engine), by means of a drive belt, to the blower 26 and specifically, to the input shaft 62, then to the rotor 29, to the timing gear 60, to the timing gear 58, and then to the rotor 28.

Extending forwardly from the main blower housing 52, and preferably cast integrally therewith, is the inlet duct 32 (best seen in FIG. 3) which, in accordance with the present invention, extends forwardly, and preferably, also extends transversely as shown in FIG. 2, for reasons which will be described subsequently. The inlet duct 32 preferably includes a forward terminal portion 66, which, as may best be seen in FIGS. 3, 4 and 5, defines a plurality of bolt holes 68, by means of which a mounting flange of a duct member (not shown herein) may be bolted to the inlet duct 32. This additional duct member, bolted to the terminal portion 66, would convey inlet air from somewhere near the forward portion of the engine compartment, into the inlet port 30 of the blower 26, in a manner generally well know.

However, in accordance with one important aspect of the invention, and as is illustrated in the drawings, there is relatively little restriction to inlet air flow imposed by the blower of the present invention. As may best be seen in FIG. 2, the path of the incoming air (see arrow) changes direction ("bends") only about forty-five degrees as it flows through the inlet duct 32 and into the inlet port 30, and then axially through the rotors 28 and 29. By way of contrast, in the typical "rear inlet" blower installation, as described previously, the path of the incoming air makes a one-hundred and eighty (180) degree turn, which severely restricts the overall air flow rate, especially at the type of elevated air flow rates involved in normal supercharger installations and applications.

Figure 3:
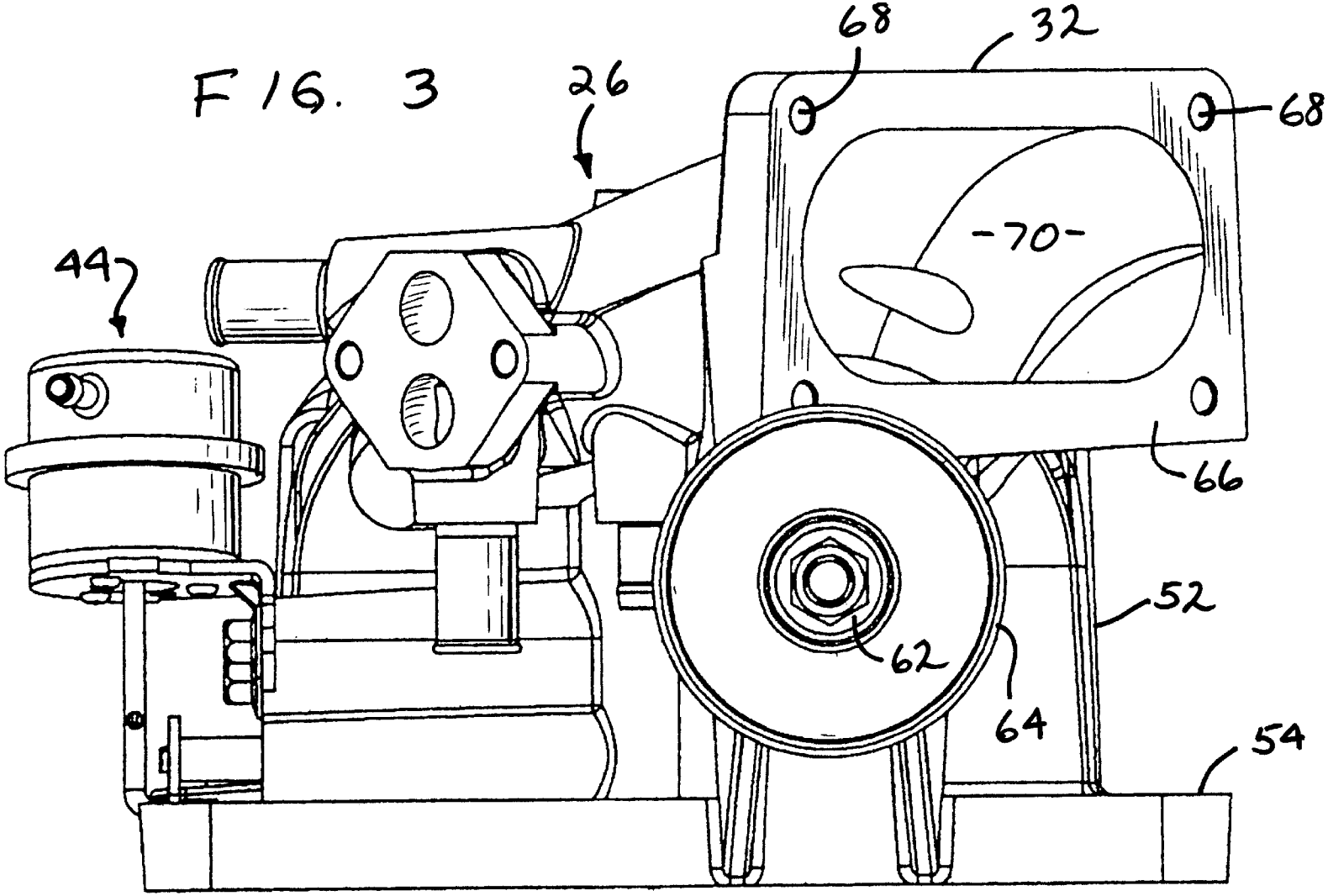
FIG. 3 is a front plan view of the blower shown in FIG. 2, but on a somewhat larger scale than FIG. 2.

In accordance with another important aspect of the present invention, and as may also best be seen in FIGS. 2 and 3, the inlet duct 32 extends, from the inlet port 30, both forwardly and transversely, so that the inlet duct 32 and forward terminal portion 66 cooperate to define a duct opening 70, and the duct opening 70 is disposed transversely from the input shaft 62. In addition, the inlet duct 32 is disposed "above" the input shaft 62, to avoid any interference between the feed duct (not shown) to the blower and the pulley 64. Having the inlet duct 32 above (in a normal installation orientation) the input shaft 62 would be preferred for another reason. With the outlet port 34 on the underside of the blower (in lower flange portion 54), it is desirable from the standpoint of air flow efficiency to have the inlet port 30 disposed toward the upper portion of the blower, as is shown in FIG. 5. Thus, for the most direct flow path into the inlet port 30, the inlet duct 32 is disposed toward the upper portion of the blower, and therefore, in the subject embodiment, passes over and above the input shaft 62.

In connection with the development of the present invention, the blower of FIGS. 2–5 ("Invention") has been tested and compared with similar blowers, but ones having either the conventional "rear inlet" arrangement, or the "top inlet" arrangement, both of which were described previously. In the course of such testing, it has been determined that the Invention provides air flow which is about five (5%) percent better than is provided by a rear inlet blower, and provides air flow which is about ten (10%) percent better than is provided by a top inlet blower. In a typical vehicle, on which a blower such as that shown herein would be utilized, increases in air flow of about five and ten percent would correspond to very noticeable increases in overall engine output. These figures would correspond to the engine operating conditions near the maximum boost point.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary blower of the backflow type comprising a housing, first and second meshed lobed rotors, each lobe having a leading end and a trailing end, said rotors being rotatably disposed in said housing for transferring relatively low pressure inlet port air to relatively high pressure outlet port air; first and second meshed timing gears fixed to be non-rotatable relative to said first and second rotors, respectively, for preventing contact of said meshed lobes of said rotors; an input drive member adapted to transmit an input drive torque to said second rotor, said housing defining an inlet port and an outlet port; characterized by:

(a) said housing having a rearward end and a forward end, adapted to be oriented toward the forward end of a vehicle engine compartment, said input drive member extending forwardly from said forward end of said housing;

(b) said inlet port being disposed at said forward end of said housing adjacent said leading end of said rotors and being defined substantially by a forward end wall of said housing, and said inlet port being disposed above said input drive member; and (c) said housing including a duct portion in open fluid communication with said inlet port, said duct portion extending forwardly and defining a forward duct opening disposed above said input drive member.

2. A rotary blower as claimed in claim 1, characterized by said first and second timing gears being disposed at said rearward end of said housing and of said rotors.

3. A rotary blower as claimed in claim 2, characterized by said input drive member comprises an input shaft fixed to rotate with said second rotor, and including an input pulley fixed to be non-rotatable relative to said input shaft.

4. A rotary blower as claimed in claim 1, characterized by said outlet port being disposed on an underside of said housing, and being disposed toward said rearward end of said housing.

5. A rotary blower as claimed in claim 1, characterized by said input drive member including an input portion, adapted to receive said input drive torque, said input portion being disposed forwardly of said forward duct opening defined by said duct portion.

6. A rotary blower as claimed in claim 1, characterized by said duct portion extending both forwardly and transversely, whereby said forward duct opening is disposed substantially transversely from said input drive member.

* * * * *